US006208308B1

(12) United States Patent
Lemons

(10) Patent No.: US 6,208,308 B1
(45) Date of Patent: Mar. 27, 2001

(54) POLYROD ANTENNA WITH FLARED NOTCH FEED

(75) Inventor: Alan C. Lemons, Redondo Beach, CA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 08/253,044

(22) Filed: Jun. 2, 1994

(51) Int. Cl.[7] ..... H01Q 13/00
(52) U.S. Cl. ..... 343/785; 343/767; 343/768
(58) Field of Search ..... 343/785, 767, 343/768

(56) References Cited

U.S. PATENT DOCUMENTS 3,128,467 * 4/1964 Lanctot ..... 343/785
3,518,691 * 6/1970 Hallendorff ..... 343/785
4,001,834 * 1/1977 Smith ..... 343/795 X
5,175,560 * 12/1992 Lucas et al. ..... 343/767

FOREIGN PATENT DOCUMENTS

3215323 * 7/1983 (DE) ..... 343/768
0009349 * 1/1977 (JP) ..... 343/785

* cited by examiner

*Primary Examiner*—Theodore M. Blum
(74) *Attorney, Agent, or Firm*—Leonard A. Alkov; Glenn H. Lenzen, Jr.

(57) ABSTRACT

A polyrod antenna fed at an end by a flared notch antenna. The space required to feed the polyrod is reduced, and a broader operating bandwidth is achieved. Gain of the antenna can be increased by increasing the polyrod length. A number of the polyrod antennas can be packed together in an array configuration.

23 Claims, 5 Drawing Sheets

POLYROD ANTENNA WITH FLARED NOTCH FEED

TECHNICAL FIELD

The invention relates to polyrod antennas, and more particularly to a new technique for feeding polyrod antennas with flared notch antennas.

BACKGROUND OF THE INVENTION

Both polyrod and flared notch antennas are part of a larger family of antennas that exploit length in the endfire direction to achieve gain. A polyrod is a cylindrical shaped polystyrene rod a few wavelengths long. Other materials such as fiberglass may be used instead of polystyrene if desired. When properly excited, the polyrod acts as an endfire aerial. Traditionally, polyrods are fed with waveguide. A matching section is usually included to transition efficiently from the waveguide to the polyrod. As with other endfire antennas, like the flared notch, the gain of the polyrod may be increased by a corresponding increase in its length in the endfire direction, as described in *The Antenna Engineering Handbook*, H. Jasik, McGraw Hill, 1961, Chapter 16, pp. 16-1 to 16-24.

The waveguide required to feed the polyrod has proven incompatible with some of the proposed applications for the polyrod. One application, adding a polyrod array to the face of a mechanically scanned slot array, would be severely constrained if not impossible to accommodate using the waveguide. Not only would the waveguide feeding the polyrods be a problem because of the aperture blockage but also the feeding network for the waveguides would require more space.

Moreover, the waveguide is bulky and requires matching sections. Secondary to this is that the system, i.e., the polyrod and waveguide, is inherently narrow banded, i.e., limited at the low end by the cut-off frequency of the waveguide.

It would therefore be advantageous to provide a technique for feeding a polyrod antenna which has reduced volume and higher gain and broader operating bandwidth than the conventional waveguide-fed antenna.

SUMMARY OF THE INVENTION

A polyrod antenna system comprises a polyrod antenna element and a feed system for feeding the polyrod element from an end thereof. In accordance with the invention, the feed system includes a flared notch antenna having a flared notch radiator section. The polyrod element is attached to the flare region of the flared notch so that the polyrod element is fed by signals as they travel along the flared notch. The antenna system operates in a first mode at which the combination of the polyrod element and the flared notch antenna act as a dielectric loaded flared notch, and in a second mode at a frequency band at which the polyrod element operates as a surface-wave antenna.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1A:
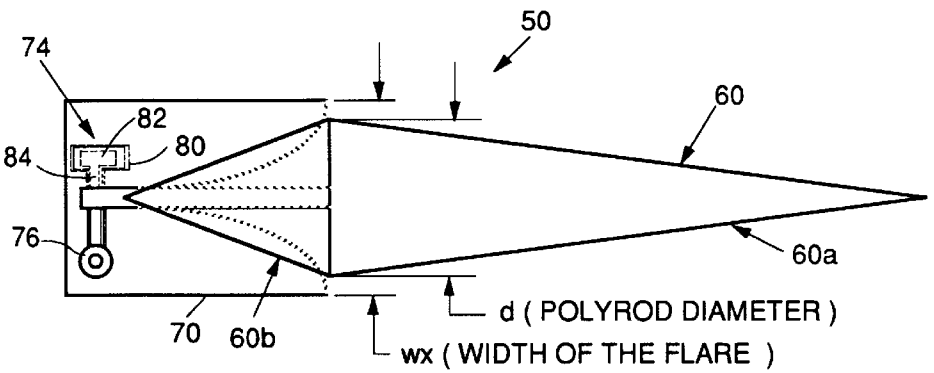
FIGS. 1A and 1B are respective side and top views of a polyrod antenna fed by a flared notch in accordance with the invention.
Figure 1B:
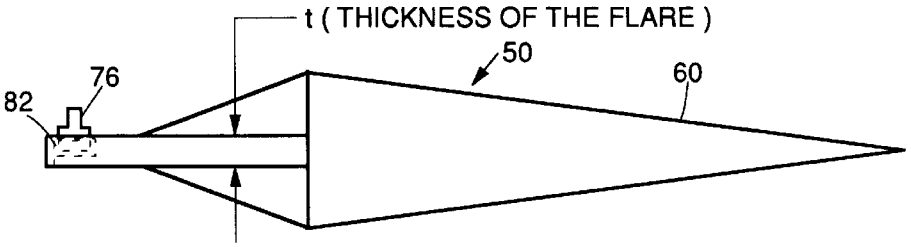

FIGS. 1A and 1B show a radiating element 50 comprising polyrod element 60 fed by a flared notch antenna 70 in accordance with the invention. The polyrod 60 is fed by energy traveling along the flared notch 72 of the antenna 70.

Figure 2B:
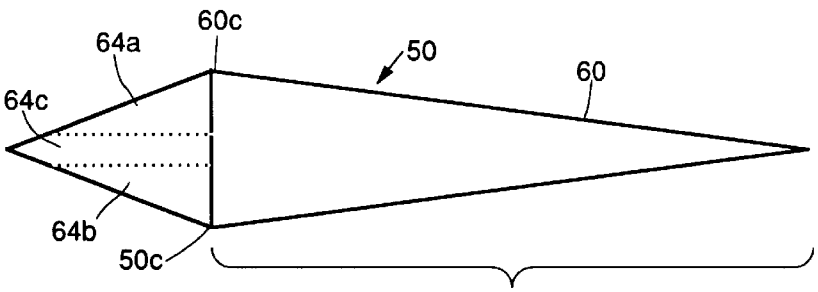
FIGS. 2A, 2B and 2C illustrate the polyrod antenna element of FIG. 1 in respective back, side and front views.
Figure 2A:
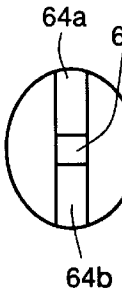
Figure 2C:
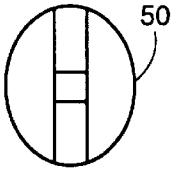

FIGS. 2A–2C illustrate the tapered polyrod element 60. The element includes a long tapered section 60A and a short tapered section 60B, divided at plane 60C. Although the polyrod 60 in this example is shown with a uniform taper on both the long and short tapered sections, other configurations may also be employed, e.g., constant diameter or non-uniformly tapered polyrods.

The flared notch 70 in this exemplary embodiment is attached to the polyrod 60 by a press fit arrangement. The short tapered portion 60B of the polyrod 60 is fabricated with two triangular shaped sections of material removed therefrom, defining triangular open sections 64A and 64B, and leaving a center section 64C of solid polyrod material. The flared notch element 70 can be fabricated of a solid piece of metal such as aluminum, of thickness t and shaped to form the flare 72. The open sections 64A and 64B are slightly undersized compared to the thickness t of the flared notch element 70, so that the polyrod element 60 can be wedged (for a press fit) into the flared notch 70. Other configurations are possible with more or less polyrod material removed from within the flare region. Also, other techniques for attachment, such as using bonding material, may be employed depending on specific design requirements.

The antenna 70 includes a balun 74 fed by a coaxial-to-stripline connector 76. As shown in FIG. 1A, a section 80 of the metal structure that makes up the flare 70 is hollowed out internally to form an internal channel 82 to accommodate a stripline transmission line 84 and balun section 74. The stripline transmission line 84 comprises a conductor line fabricated on a dielectric substrate suspended within the open channel 82. The stripline 84 runs within the channel 82 from the coaxial connector 76 on one side of the slotline region 78 of the flare to the balun section 74 on the other side. The slotline region 78 is an open section formed in the solid metal structure of the flare 70. The stripline 84 is exposed at the slotline region 78. Other types of transmission lines may be used to feed the slotline region. Balun refers to the transition from an unbalanced transmission line (in this case the stripline 84) to a balanced transmission line (in this case the slotline). The function of the balun is to provide an efficient transition between the stripline and the slotline such that maximum power transfer is achieved at that transition over the frequency band of operation.

Although the flared notch antenna 70 employs an exponentially tapered flared notch 72, other configurations may also be employed. For example, a linearly tapered flared notch, or a combination of linearly (or exponentially) tapered flare and constant width flare. In any case the balun structure would be identical to that used with the exponentially flared notch. Other connector and balun configurations may alternatively be employed.

The shape of the long tapered section 60A of the polyrod is determined from traditional polyrod design techniques. The shape of the small tapered section 60B is selected to smooth the impedance from the slotline through the polyrod into free space.

Figure 3A:
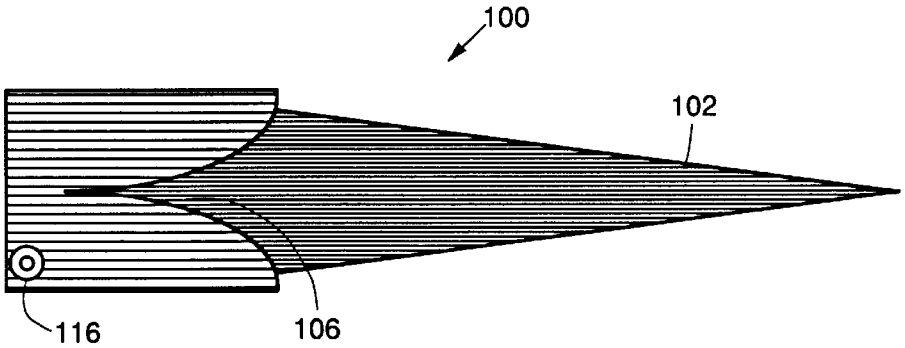
FIGS. 3A–3C illustrate respective top side and bottom views of an alternate embodiment of a flared notch fed polyrod antenna, having a single piece construction.
Figure 3B:
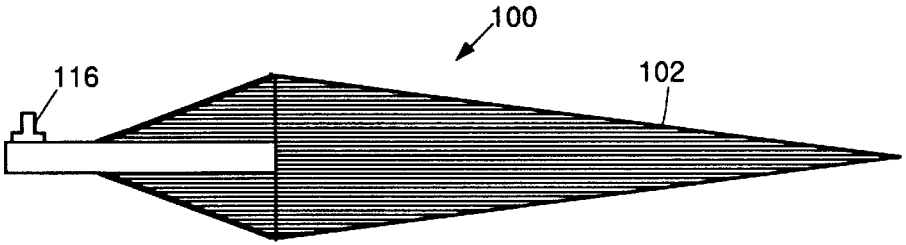
Figure 3C:
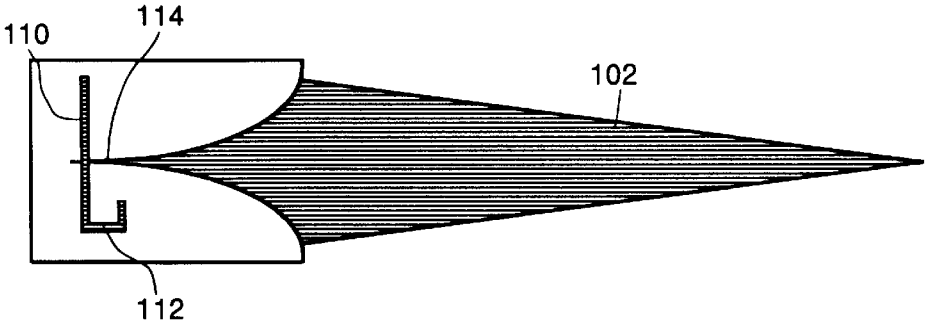

The exemplary polyrod-flared notch radiating element 50 is fabricated of separate polyrod and flare elements. Alternatively, the polyrod-flared notch can be fabricated from a single piece of material and the material may be plated or painted with a conductive coating in the area designated for the flare. FIGS. 3A–3C show a single piece polyrod-flared notch feed radiating element 100 in accordance with the invention. The polyrod plastic material is plated with metal in the areas needed to define the flare feed, and is otherwise exposed. The element 100 includes the polyrod portion 102, again having a long tapered section and a short tapered section, and a flared notch section formed of a flat rectilinear portion. One surface 104 of the flat portion is plated with metal to define the flared notch 106. Here again, the polyrod portion 102 extends into the flared notch 106, and is fed with energy traveling along the flare region. In this exemplary configuration, the flare is fed with a microstrip transmission line 110 and balun section 112 at the slotline region 114 of the flare. The line 110 and balun section 112 are defined by a metallization pattern on the opposed surface of the polyrod material from the plated area 104, as shown in FIG. 3C. The line 110 is connected to coaxial connector 116. Other feeding configurations using different balun sections may be used.

Figure 4B:
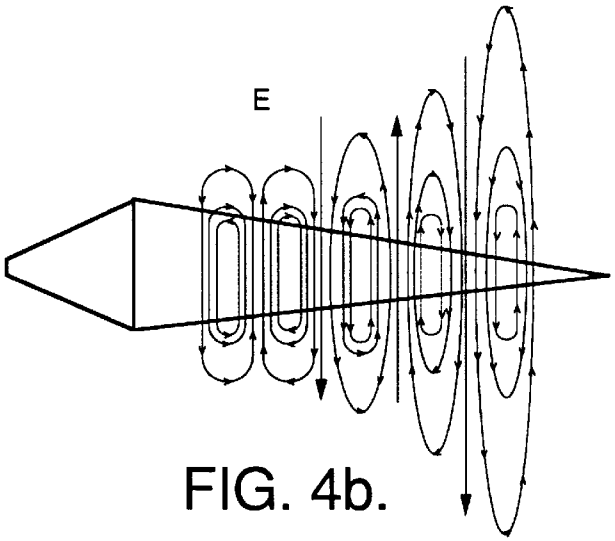
FIGS. 4A–4D show representations of the electric field configuration of the polyrod element and the flared notch element.
Figure 4D:
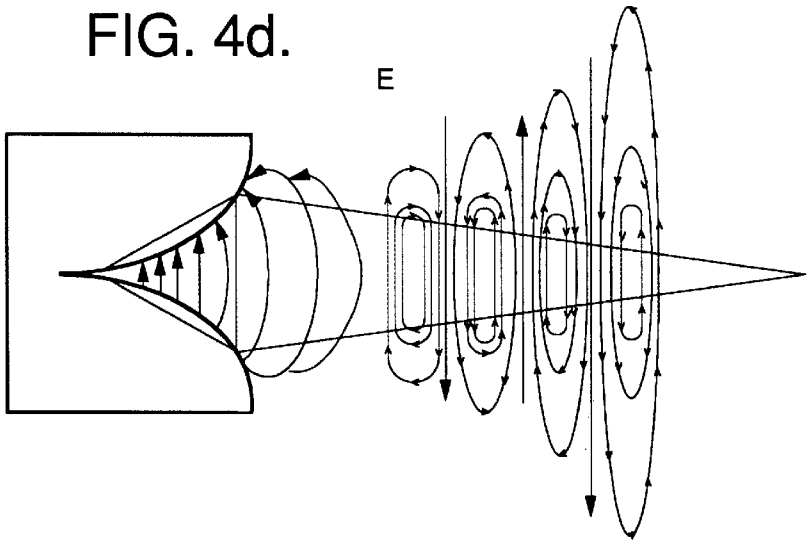
Figure 4A:
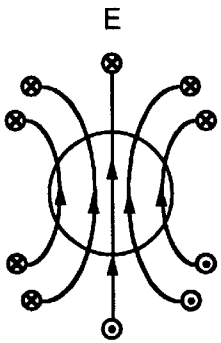
Figure 4C:
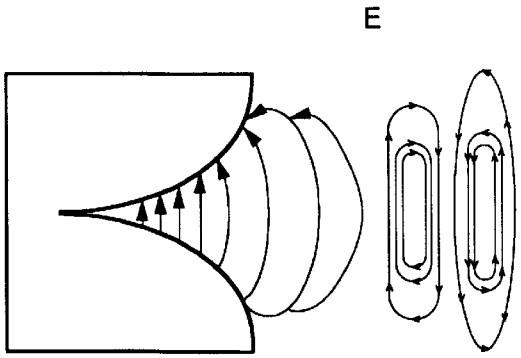
Figure 5C:
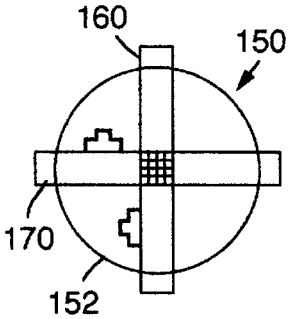
FIGS. 5A–5D illustrate polyrod with orthogonal flared notch feed elements to provide a circularly polarized radiating element.
Figure 5D:
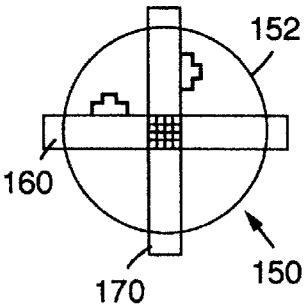
Figure 5A:
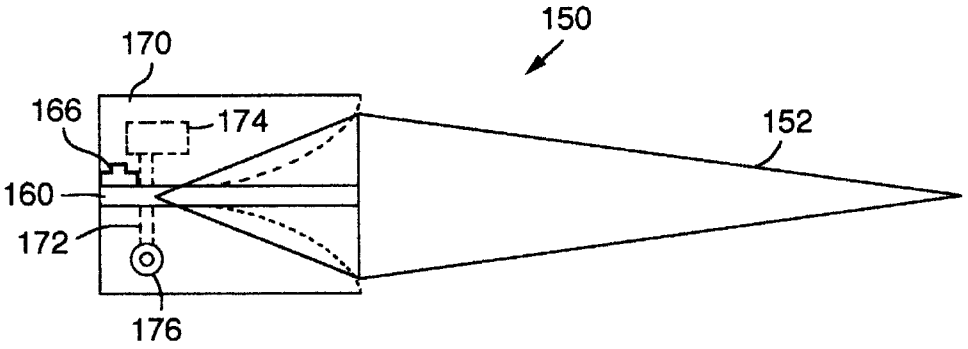
Figure 5B:
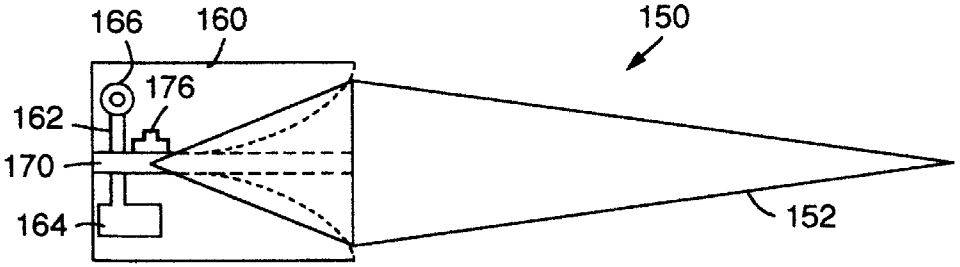

FIGS. 4A–4D show the similarity between the radiating properties of the flare and the polyrod, by representations of the typical electric field lines as energy propagates along the polyrod, the flared notch, and the combination. FIG. 4A is a schematic transverse cross-sectional view of a polyrod, and illustrates the electric field lines transverse to the polyrod. FIG. 4B is a schematic longitudinal cross-sectional view of a polyrod, illustrating the longitudinally extending electric field lines. FIG. 4C illustrates the electric field lines for a flared notch radiator. FIG. 4D is a schematic diagram of the combined polyrod fed with a flared notch.

Because of the symmetry with which a polyrod is constructed, it is possible to feed the polyrod with two flared notches and achieve circular polarization as shown in an exemplary system 150 in FIGS. 5A–5D. Here, the polyrod 152 is fed along one plane by a first flared notch radiator 160, and along a second orthogonal plane by a second flared notch radiator 170. The radiator 160 is fed by an embedded stripline 162 extending within an internal open channel formed within the body of the radiator 160 as in the flared radiator 70 of FIGS. 1A–1B, extending from coaxial connector 166 to balun 164 on opposite sides of a slotline region. Similarly, the radiator 170 is fed by an embedded stripline 172 extending within an internal open channel formed within the body of the radiator 170. The polyrod 152 is formed with four relieved open areas at the short tapered end, two to receive the flared notch of radiator 160 and two orthogonally placed relative to the first two open areas to receive the flared notch of radiator 170. The respective radiators 160 and 170 are centered on the longitudinal axis of the polyrod.

Figure 6A:
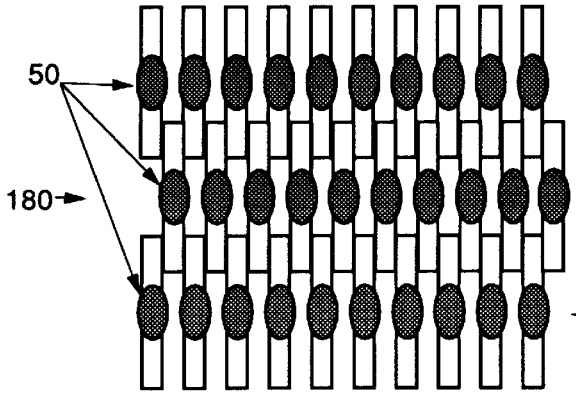
FIGS. 6A and 6B show a tightly spaced array of flare fed polyrods in accordance with the invention.
Figure 6B:
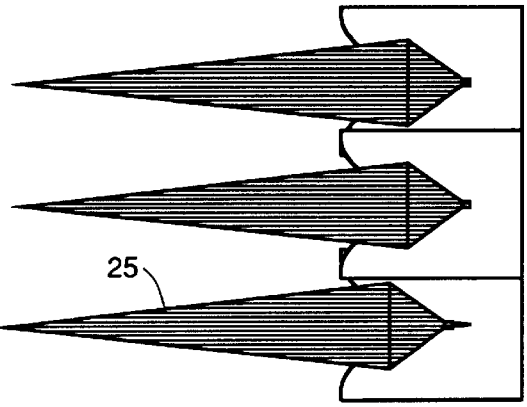

By replacing the conventional waveguide feed with a flared notch feed element in accordance with the invention, many advantages can be realized. First, the space required to feed the polyrod is reduced and a separate matching section is no longer necessary. Secondly, higher gain and a broader operating bandwidth are achieved using the flared notch—polyrod combination. Also, since the new feeding technique requires less space to accommodate the polyrod, the elements may be packed tighter together in an array configuration, as shown in FIGS. 6A–6B. Here the array 180 comprises rows of flared notch-fed polyrod elements 50 as in FIGS. 1–2, with the elements in the middle row offset from the elements of the adjacent rows to permit tighter packing of the elements.

Another advantage of the invention lies in the ability to replace flared notch length with polyrod length. Ordinarily, to increase the gain of a flared notch antenna, the length of the flare must be increased. This can require more space. By lengthening the polyrod instead, the same gain may be achieved without having to increase the length of the flared notch, thus reducing the necessary amount of metal, weight and space.

A mechanical advantage of the flare-polyrod combination lies in the fact that the flared notch structure stabilizes the base of the polyrod. For some applications, this same degree of mechanical stabilization may not be possible with a waveguide-fed polyrod.

As a system, the flared notch-fed polyrod antenna 50 works in two modes. One mode is the frequency band at which the combination acts as a dielectric loaded flare, where the polyrod, fabricated of dielectric material, serves as the dielectric load. The other mode is the band over which the polyrod operates as a surface-wave antenna. The lower frequency bound of the first mode depends on the width of the flare. For efficient radiation, the electrical length of the flare width should be greater than or equal to one half of one wavelength. With the polyrod present, this condition will be altered somewhat because the dielectric material of which the polyrod is fabricated will tend to effectively increase the electrical length of the flare width, and thus lower the frequency bound. The transition from the first mode to the second mode will occur when the electrical length of the diameter, d (or largest cross-sectional dimension) of the polyrod is large enough, in wavelengths, to support an appreciable surface wave. This transition occurs at different frequencies for different polyrod materials, and can be determined through experiment. The upper frequency bound of the second mode occurs when the ratio of polyrod diameter to operating wavelength reaches a large enough value such that higher order waveguide modes are excited within the polyrod, at which point the antenna radiation pattern of the combination will have a null in the end fire direction.

Depending upon particular application requirements, the dielectric material of the polyrod with its associated dielectric constant can be used as a tuning parameter. Since the wavelength inside the polyrod material (for materials with dielectric constants greater than unity) is effectively lowered, the starting frequency of the region over which the flare-polyrod combination works as a loaded flare is also lowered. Moreover, the transition point between the modes will also be moved down in frequency. By choosing the dielectric constant correctly through empirical testing and analysis, the frequency band of operation may be adjusted for desired performance.

Recent EW passive listening, passive attack, and increased situational awareness requirements have called for antennas with high (12 dB to 16 dB) gain that must be co-located with the main radar antenna array, in most cases on the face of a slotted planar array, so that the capabilities of the existing gimbal may be exploited. Traditional solutions to this problem, such as a slotted array which uses aperture area to achieve the necessary gain, would not work in this case since there is no practical way to mount them on the front of the array without severely impacting the performance of the main array. An array of flared notch fed polyrods can be used in such an application. The unique feature of the flared notch fed polyrod that makes it useful in these systems is that it can provide the necessary gain using extent in length, rather than aperture area, without seriously impacting the performance of the main array. For example, a flared notch fed polyrod, 3.5 wavelengths long, has a gain of approximately 14.5 dB. To get the same gain using a slot array would require at least nine slots.

Figure 7A:
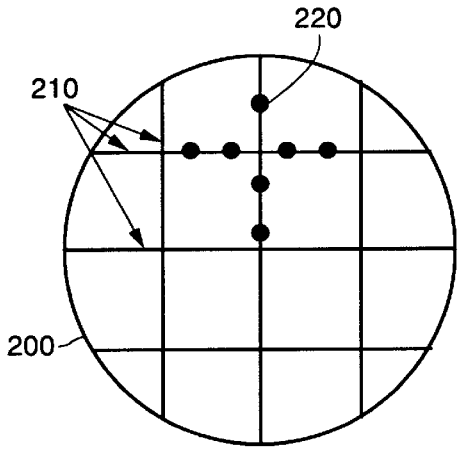
FIGS. 7A and 7B show a polyrod antenna array, wherein the polyrod elements are located at radiating slot module boundaries of a typical slotted planar array.
Figure 7B:
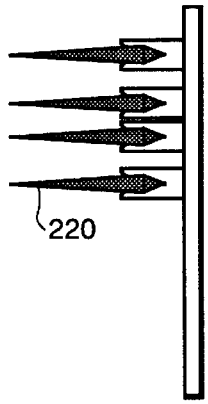

FIG. 7A shows the outline of a slotted planar array 200 for use as a radar antenna. The planar slotted array 200 has radiating slot boundaries 210. Co-located with the radar antenna is a polyrod antenna system whose elements 220 are located at the radiating slot module boundaries 210. FIG. 7B shows an elevation view to the slotted planar array. Among the advantages this feeding technique offers over the traditional waveguide fed polyrod are reduced volume, weight, components, complexity, and higher gain and broader operating bandwidth.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A dual array radar antenna system, comprising:

a main radar antenna array comprising a plurality of spaced main antenna radiating elements disposed within an aperture area;

a secondary radar antenna array comprising a plurality of secondary antenna radiating elements co-located with said main antenna radiating elements within said aperture area, each of said secondary antenna radiating elements comprising:

a dielectric rod antenna element; and a flared notch radiating antenna for feeding electromagnetic signals to and from said dielectric rod element, said flared notch antenna comprising an electrically conductive flare structure defining first and second tapered flare elements and a slot region at a flared notch between the flare elements, and a balun for exciting the slot region, said flared notch antenna free of electrically conductive shielding surrounding said flare structure; and wherein the dielectric rod includes a first end, and said first end is secured within said flared notch so that the dielectric rod is fed by signals radiated from the flared notch radiating antenna.

2. The system of claim 1 wherein said dielectric rod element has first and second ends and an intermediate area of a largest cross-sectional dimension of said rod element, and wherein said rod element comprises a short tapered section extending between said intermediate area and said first end and a long tapered section extending between said intermediate area and said second end.

3. The system of claim 1 wherein a narrow open channel is defined in said dielectric rod element at said first end, said flared notch antenna comprises a planar element, and wherein said planar element is fitted into said open channel.

4. The system of claim 3 wherein a width dimension of said channel is slightly smaller than a width dimension of said planar element, and wherein said planar element is press fitted into said open channel.

5. The system of claim 1 wherein said flared notch antenna comprises an exponentially tapered flared notch.

6. The antenna system of claim 1 wherein said antenna system operates in a first mode at a frequency band at which said dielectric rod element operates as a surface-wave antenna, and in a second mode at which said rod element and said flared notch antenna operate as a dielectric loaded flared notch.

7. The antenna system of claim 6 wherein a lower frequency bound of said second mode of operation is dependent on a width dimension of said flared notch, and said second mode of operation occurs at wavelengths at which the effective electrical path length determined by said width dimension is equal to or greater than one half said wavelength.

8. The antenna system of claim 6 wherein an upper frequency bound of said first mode occurs when a ratio of a largest dielectric rod element cross-sectional dimension to an operating wavelength reaches a large enough value such that higher order waveguide modes are excited within said rod element and an antenna radiation pattern of said antenna system has a null in an end fire direction.

9. The antenna system of claim 1 wherein said main antenna array comprises a slotted planar array.

10. The antenna system of claim 9 wherein said main slotted planar array is arranged to define radiating slot module boundaries, and said secondary array radiating elements are located at said boundaries.

11. A circularly polarized dielectric rod antenna system, comprising:

a dielectric rod antenna element;

a feed system for feeding said dielectric rod element from an end thereof, said feed system comprising a first flared notch antenna having a first flared notch radiator section and a second flared notch antenna having a second flared notch radiator section, said first and second flared notch sections being disposed along a longitudinal axis of said rod element and orthogonally with respect to each other, said rod element secured at said flared notches so that said rod element is fed by signals propagating along said flared notches, and wherein each said flared notch antenna comprises an electrically conductive flare structure defining first and second tapered flare elements and a slot region at a flared notch between the flare elements. and a balun for exciting the slot region, said flared notch antenna free of electrically conductive shielding surrounding said flare structure.

12. The antenna system of claim 11, wherein said antenna system operates in a first mode at a frequency band at which said dielectric rod element operates as a surface-wave antenna, and in a second mode at which said rod element and said flared notch antennas operate as respective dielectric loaded flared notches.

13. The antenna system of claim 11 wherein said first flared notch section is disposed in a first plane, said second flared notch section is disposed in a second plane, and said first and second planes are orthogonal.

14. An antenna system, comprising:

a dielectric rod antenna element; and a flared notch radiating antenna for feeding electromagnetic signals to and from said dielectric rod element, said flared notch antenna comprising an electrically conductive flare structure defining first and second tapered flare elements and a slot region at a flared notch between the flare elements, and a balun for exciting the slot region, said flared notch antenna free of electrically conductive shielding surrounding said flare structure; and wherein the dielectric rod includes a first end, and said first end is secured within said flared notch so that the dielectric rod is fed by signals radiated from the flared notch radiating antenna, said antenna system having a directivity characteristic that is greater than a corresponding directivity characteristic of said dielectric rod antenna element and a corresponding directivity characteristic of said flared notch antenna.

15. The antenna system of claim 14 wherein the conductive flare structure has a flare width dimension, said dielectric rod has a rod width dimension, and said flare width dimension exceeds said rod width dimension.

16. The antenna system of claim 15 wherein said dielectric rod has a circular cross-sectional configuration, and said width dimension is a diameter dimension of said rod.

17. The system of claim 14 wherein said dielectric rod element has first and second ends and an intermediate area of a largest cross-sectional dimension of said dielectric rod element, and wherein said rod element comprises a short tapered section extending between said intermediate area and said first end and a long tapered section extending between said intermediate area and said second end.

18. The system of claim 17 wherein a narrow open channel is defined in said dielectric rod element at said first end, said flared notch antenna comprises a planar element, and wherein said planar element is fitted into said open channel.

19. The system of claim 18 wherein a width dimension of said channel is slightly smaller than a width dimension of said planar element, and wherein said planar element is press fitted into said open channel.

20. The system of claim 14 wherein said flared notch antenna comprises an exponentially tapered flared notch.

21. The antenna system of claim 14 wherein said antenna system operates in a first mode at a frequency band at which said dielectric element operates as a surface-wave antenna, and in a second mode at which said rod element and said flared notch antenna operate as a dielectric loaded flared notch.

22. The antenna system of claim 21 wherein a lower frequency bound of said second mode of operation is dependent on a width dimension of said flared notch, and said second mode of operation occurs at wavelengths at which the effective electrical path length determined by said width dimension is equal to or greater than one half said wavelength.

23. The antenna system of claim 21 wherein an upper frequency bound of said first mode occurs when a ratio of a largest polyrod cross-sectional dimension to an operating wavelength reaches a large enough value such that higher order waveguide modes are excited within said dielectric rod element and an antenna radiation pattern of said antenna system has a null in an end fire direction.

* * * * *